United States Patent [19]

Walmer et al.

[11] 4,306,371

[45] Dec. 22, 1981

[54] DOLL HOUSE WITH CONNECTOR ELEMENT CONNECTING THREE WALL MEMBERS

[76] Inventors: Harry E. Walmer, 721 N. Overlook Dr., Alexandria, Va. 22305; Judd Horbaly, 125 Commonwealth Ave., Alexandria, Va. 22309

[21] Appl. No.: 115,479

[22] Filed: Jan. 25, 1980

[51] Int. Cl.[3] ..... A63H 3/52

[52] U.S. Cl. ..... 46/19

[58] Field of Search ..... 46/18, 19, 20, 21; 35/16

[56] References Cited

U.S. PATENT DOCUMENTS

| | | | |
|---|---|---|---|
| 1,337,171 | 4/1920 | Ward | 46/19 |
| 1,449,519 | 3/1923 | Layton | 35/16 |
| 2,441,761 | 5/1948 | Guelicher | 46/19 |
| 2,968,118 | 1/1961 | Paulson | 46/19 |
| 3,751,848 | 8/1973 | Ahlstrand | 46/19 |
| 3,906,659 | 9/1975 | Walmer | 46/19 |
| 4,058,909 | 11/1977 | Poleri | 35/16 |

*Primary Examiner*—F. Barry Shay

*Attorney, Agent, or Firm*—James C. Wray

[57] ABSTRACT

A doll house has a base with a series of interconnected grooves, a first front wall, two tall vertical front walls, a shorter side wall and a shorter interior wall. A floor member engages those walls and cantilevers outward over the shorter interior wall. Together the floor member and base and walls form a rigid frame to which remaining panels of the doll house are connected. A front door assembly with side lights and platform steps are grooved to be tightly held within a door opening. A second short front wall and a side wall are captured between the cantilevered portion of the floor member and the base, further promoting stability. An intermediate floor and front, top, and side roof panels and chimney connectors complete the basic structure.

9 Claims, 10 Drawing Figures

DOLL HOUSE WITH CONNECTOR ELEMENT CONNECTING THREE WALL MEMBERS

BACKGROUND OF THE INVENTION

This invention relates to doll houses and toy houses particulary of the knock-down or collapsible type of simplified construction which are capable of being easily constructed or taken apart.

Historically many types of doll houses and toy houses have been provided. Most of the houses are permanently constructed, with attendant problems of shipping and storage. Knock-down houses of prior art design have required special tools and difficult assembly steps for construction. Once constructed, knock-down houses of prior art designs have experienced some difficulties in stability.

The inventors of the present invention have developed knock-down doll houses which go together simply with minimal or no tools and which remain stable once constructed. The present invention is a result of continued efforts to improve ease in assembly and rigidity of assembled construction of knock-down doll houses.

SUMMARY OF THE INVENTION

A doll house has a base with a series of interconnected grooves, a first front wall, two tall vertical front walls, a shorter side wall and a shorter interior wall. A floor member engages those walls and cantilevers outward over the shorter interior wall. Together the floor member and base and walls from a rigid frame to which remaining panels of the doll house are connected. A front door assembly with side lights and platform steps are grooved to be tightly held within a door opening. A second short front wall and a side wall are captured between the cantilevered portion of the floor member and the base, further promoting stability. An intermediate floor and front, top, and side roof panels and chimney connectors complete the basic structure.

The present invention provides rigidity in construction by cantilevering a main horizontal member and then placing offset vertical member below the cantilevered portion of the horizontal member. This ensures the rigidity of the basic structure and enables the removal of holding members required for intermediate steps in the construction.

The present invention increases the space within the knock-down doll house and increases the panel members which make up the doll house while at the same time enabling the reduction of non-aesthetic holding members which are less desirable in the house construction.

An easily aseembled knock-down doll house apparatus includes a base having plural connected angularly oriented slots for receiving bottom edges of vertical walls, the slots comprising a first elongated slot slightly spaced inward from a first elongated edge of the base for receiving a front vertical wall and plural slots communicating with the first slot and extending angularly therefrom toward a second opposite edge of the base, and a further slot extending angularly outward from an outer one of the plural slots and extending toward an edge of the base intermediate the first and second elongated edges, a remote slot extending from a portion of the further slot remote from the outer one of the plural slots toward the second edge of the base, a front vertical wall member mounted in the first slot, vertical transverse wall members mounted in the plural slots, the vertical transverse wall members comprising at least one relatively short outer wall member and at least one relatively tall inner member, a floor member connected to the vertical transverse wall members parallel to the base and space therefrom, the floor member extending over the outer vertical transverse wall members and through the inner transverse wall members, and the floor member cantilevering outward beyond the vertical wall member positioned in the first outer slot and over the further slot and remote slot, and means for connecting the base, the vertical transverse wall members and the floor member for forming thereby a rigid skeletal frame of the base, vertical transverse wall members and floor member by which a doll house comprising the members is rigidly supported.

The doll house apparatus of the invention includes a second relatively short frontal wall member mounted in the further slot and extending between the base and a cantilevered portion of the floor member and having a first vertical edge connected to a relatively short outer wall member, a side wall member mounted in the remote slot and extending between the base and a cantilevered portion of the floor member and having a first vertical edge connected to a vertical edge of the second frontal member which is spaced from the relatively short outer wall member.

In apparatus of the invention the tall inner members comprise inward and upward sloping frontal edges at positions thereof above the floor member and the house includes a roof front member having a lower edge connected to a front edge of the floor member, the roof front member sloping inwardly and resting against the inward sloped edges of the relatively tall inner members, a roof top member resting on upper edges of the relatively tall inner members and having a front edge connected to an upper edge of the roof front member and means for connecting the roof top member to the relatively tall inner members thereby cooperating with the roof top member and the floor member to hold the roof front member in assembled condition, the floor member and the roof top member having complimentary upward and downward openings slot means respectively, and first and second roof side members mounted in the slot means.

The doll house apparatus of the invention has upward opening slots in the floor member are positioned immediately above the relatively short vertical wall members and wherein a portion of the floor member cantilevered outward beyond the slot comprises an outer deck member.

In apparatus of the doll house the vertical transverse wall members comprise horizontal slits extending partially through the wall members and further includes an intermediate floor member having a plan form similar to a plan from of the first said floor member and fitting within the slits and engaging in rearward opening slot means positioned on the frontal wall member.

Doll house apparatus includes a base having angularly oriented slot means for receiving vertical walls, plural vertical walls for inserting the grooves, at least one of the vertical walls having a door opening extending upward into the wall from a bottom edge of the wall, a door assembly for fitting in the opening, the door assembly comprising side members having outwardly facing first and second vertical slots for receiving opposite vertical edges of the door opening in the slots and the door assembly having an outer facing on one side of the slots and having an interior facing on the other side of the slots and a movable door hinged to one of the side members and abuting the other of said side members.

In apparatus of the invention the door assembly further includes a top member connected to the side members, the top member having an outer facial portion and an inner facial portion, and having an upward opening horizontal slot between the inner and outer facial portions for receiving an upper edge of the door opening.

The apparatus of the invention includes a step assembly, the step assembly having first and second platforms supported respectively on first and second riser blocks, the first and second platforms and first and second riser blocks having opposite outward opening vertical grooves for receiving outer edges of the door opening.

In easily assembled knock-down doll houses having an interlocking door assembly, the parts are fitted together and held together only with pegs.

A generally rectangular first floor member includes front and left and right side grooves in the top surface thereof, at least one intermediate groove in said surface parallel to said left and right grooves, a groove parallel, outside of and shorter in length than said left and right side grooves, a groove parallel to but not overlapping the length of said front groove and which runs perpendicular to and between the side groove adjacent the shorter outside groove and the foremost end of said shorter outside groove, and a series of in-line holes disposed behind said front groove.

A front wall member has a size and shape to have its bottom edge engage said front grooves of said first floor member, comprising left and right vertical L-shaped side beams, at least one segmented horizontal beam member disposed on the inner side, one top horizontal beam member containing a top inwardly slanted groove, an inward side groove, and which also has inwardly disposed vertical slots corresponding with the notches formed of the space between said segments of inwardly disposed horizontal beam member and the intermediate grooves in said first floor member, a cut out portion in the portion of the front wall adjacent said front grooves of said first floor member, at least two holes disposed at the bottom edge and inner front wall edges disposed in the front wall member.

A recessed front wall member has a size and shape to have its bottom edge engage said groove that is parallel to said front groove in said first floor member, a side edge to engage said vertical slotted beam in said intermediate side wall, and a top edge adapted to engage said downwardly disposed horizontal front beam member in said third floor member, and which comprises a vertical L-shaped side beam, and at least one horizontal beam member disposed on the inner side.

An intermediate side wall member is adapted to have its lower edge engage a respective said side groove in said first floor member, to have its front edge engage one of said vertical L-shaped front wall beams, and to have its top edge engage said downwardly disposed intermediate slotted beam in said third floor member, comprising an outwardly disposed vertical grooved beam member with an intermediate horizontal slot forming a notch therein, an intermediate horizontal slot extending forwardly from the rear edge, at least two holes disposed at the top and bottom rear corners, and open doorways cut into said wall member.

An extension front wall has a size and shape to have its bottom edge engage said groove that is parallel to but not overlapping said front groove in said first floor member, to have its top edge engage said groove in said downwardly disposed front beam in said third floor member, and to have a side edge engage said groove in said vertical beam in said intermediate side wall member, and which comprises a vertical L-shaped beam member at one side edge, and an intermediate horizontal inwardly disposed grooved beam member.

An extension side wall has a size and shape to have its bottom edge engage said groove that is parallel to and shorter than said side grooves in said first floor member, to have its frontmost side edge engage said L-shaped beam in said extension front wall member, and to have its top edge engage said groove in said downwardly disposed side beam in said third floor member, and comprises an intermediate horizontal inwardly disposed grooved beam member and holes disposed at the rear of the top and bottom edges and in said grooved beam member.

A second floor member adapts to have its side and front edges engage said grooves of said intermediate inner beam members of said side, extension side, front, and extension front walks, and to engage said horizontal notch formed in said vertical intermediate beam in said intermediate side wall member, and comprising a stairwell near the front edge, at least two holes disposed at the far right and left edges near the rear edge, and at least two horizontal slots extending rearwardly from the front edge, said slots adapted to engage said horizontal slots of said intermediate and intermediate side wall members.

A side wall has a respective size and shape to have its front edge engage said L-shaped beam of said front wall member, and its bottom edge engage one of said side grooves as of said first floor member, comprising at least one inner horizontal beam member having an inward side groove, a top horizontal beam member containing a top inwardly slanted groove and an inward side groove, and at least two holes disposed at the lower rear corner and above it in an inner horizontal beam member.

At least one intermediate wall member is adapted to have its lower edge engage a respective said intermediate groove in said first floor and to have its forward edge engage said notches and vertical slots respectively in said segmented horizontal and top front beam members, comprising at least one intermediate horizontal slot extending forwardly from the rear edge; open doorways formed above and in extension of said intermediate horizontal slots, a recessed lower rear edge extending from the level of said first floor member to the level of the lowest of said intermediate horizontal slots, a forward edge having its upper portions angled inwardly, and holes disposed at the bottom, forward, and top edges.

A third floor member adapts to have its front edge and a side edge respectively engage said inward side grooves in said front and side wall top beam members, comprising a stairwell near the front edge, holes disposed along the front and side edges, a side horizontal beam disposed in a downward direction, a downwardly disposed intermediate grooved beam member parallel to and longer than said side beam, an upwardly disposed beam member directly above said downwardly disposed intermediate beam member with an inwardly slanting groove disposed therein, a downwardly disposed beam member perpendicular to and running between said side and intermediate beam members at the foremost edge of said floor member, and at least one horizontal slot extending rearwardly from the front edge, said slot adapted to engage said horizontal slot of said intermediate wall member.

Front, left and right roof wall members are disposed with bottom edges in said slanted grooves in molding of said front and side top beam members and said intermediate upwardly disposed beam member in said third floor member, and said front roof member comprising left and right side L-shaped beam members, said front roof member having at least two dormer window units disposed therein.

A top roof member includes chimney holes disposed therein, left, right, and front beam members with outwardly slanted grooves disposed thereunder, a rear edge molding beam and said front beam member having inwardly disposed notches which correspond with said intermediate wall members and said chimney holes, said outwardly slanting grooves in said front, left, and right beams respectively engaging the top edges of said front, left and right roof members.

A chimney member contains a pair of parallel downwardly projecting members is adapted to be inserted in said roof hole, to straddle said center wall and to be secured thereto by a peg inserted in aligned holes in said center wall and said parallel members.

A plurality of pegs adapts to be inserted in holes contained in said beams, grooves, wall and floor members at their junctures with each other for retaining said assembled structure together.

An easily assembled knock-down type of doll house includes front and side wall members, front, side and top roof members, intermediate wall and floor members, and a doorway assembly including side door members with inner grooves disposed therein, step member, door members, door overhang member and cross member, wherein inner front wall edges are disposed in side inner grooves of said side door member whereby said doorway assembly is secured by and within the front wall member.

DETAILED DESCRIPTION OF THE DRAWINGS

Figure 1:
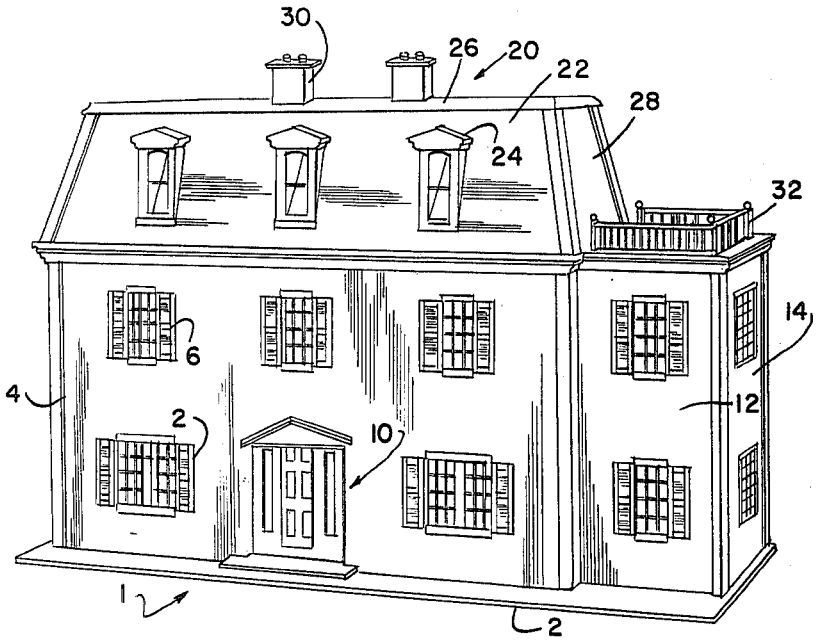
FIG. 1 is a front perspective view of a doll house constructed according to the present invention.

Referring to FIG. 1, the doll house is generally indicated by the numeral 1. The doll house has a base 2, a main front panel 4 with upper and lower window assemblies 2 and 6 respectively. A door assembly 10 is fitted in the front panel 4. An auxiliary front panel 12 is provided and a side panel 14 is shown in FIG. 1.

Roof structure 20 includes a front roof panel 22 with gables 24, a top roof panel 26 and side roof panels 28. Chimneys 30 and railing 32 complete the elements shown in FIG. 1.

Figure 2:
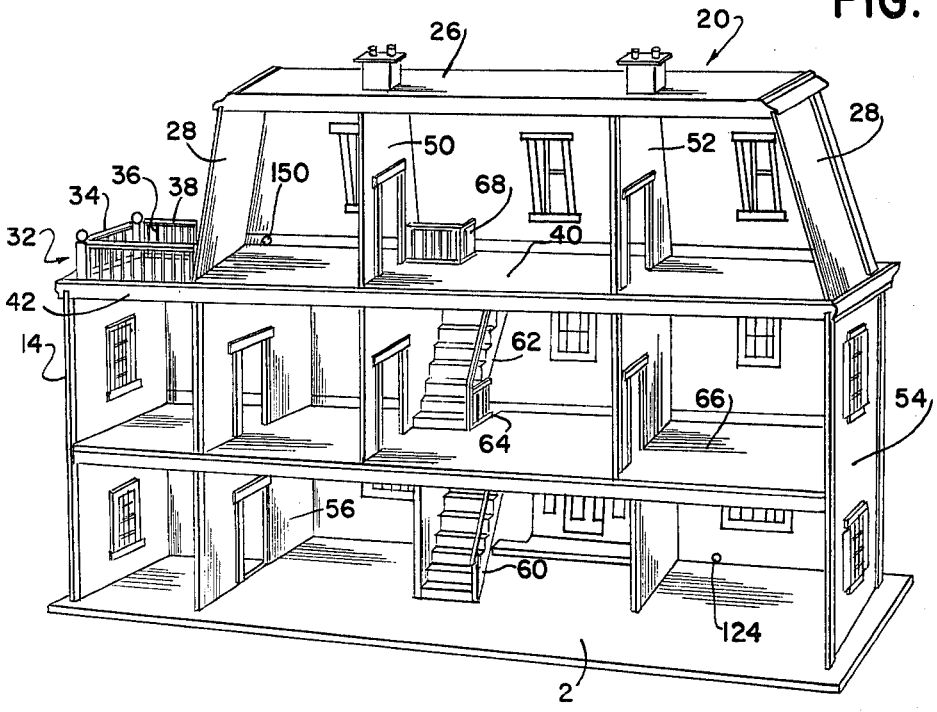
FIG. 2 is a rear perspective view showing the doll house of FIG. 1.

As shown in FIG. 2, the railing 32 has three separate elements 34, 36, and 38 which are connectable to the cantilevered deck portion 42 of floor member 40. The doll house is seen to have central relatively tall vertical members 50 and 52 and relatively short outer wall 54 and inner wall 56. Lower stair 60 is connectable to the base and upper stair 62 with railing 64 attached is connected between floor members 40 and 66. Upper railing 68 completes the structure.

Figure 3A:
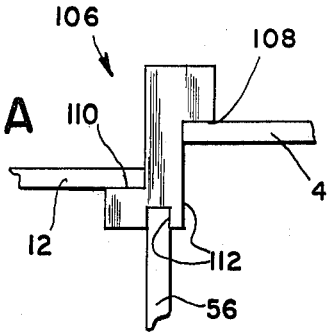
FIG. 3A shows an L-shaped connector used between main and auxiliary front wall panels of the doll house.
Figure 3:
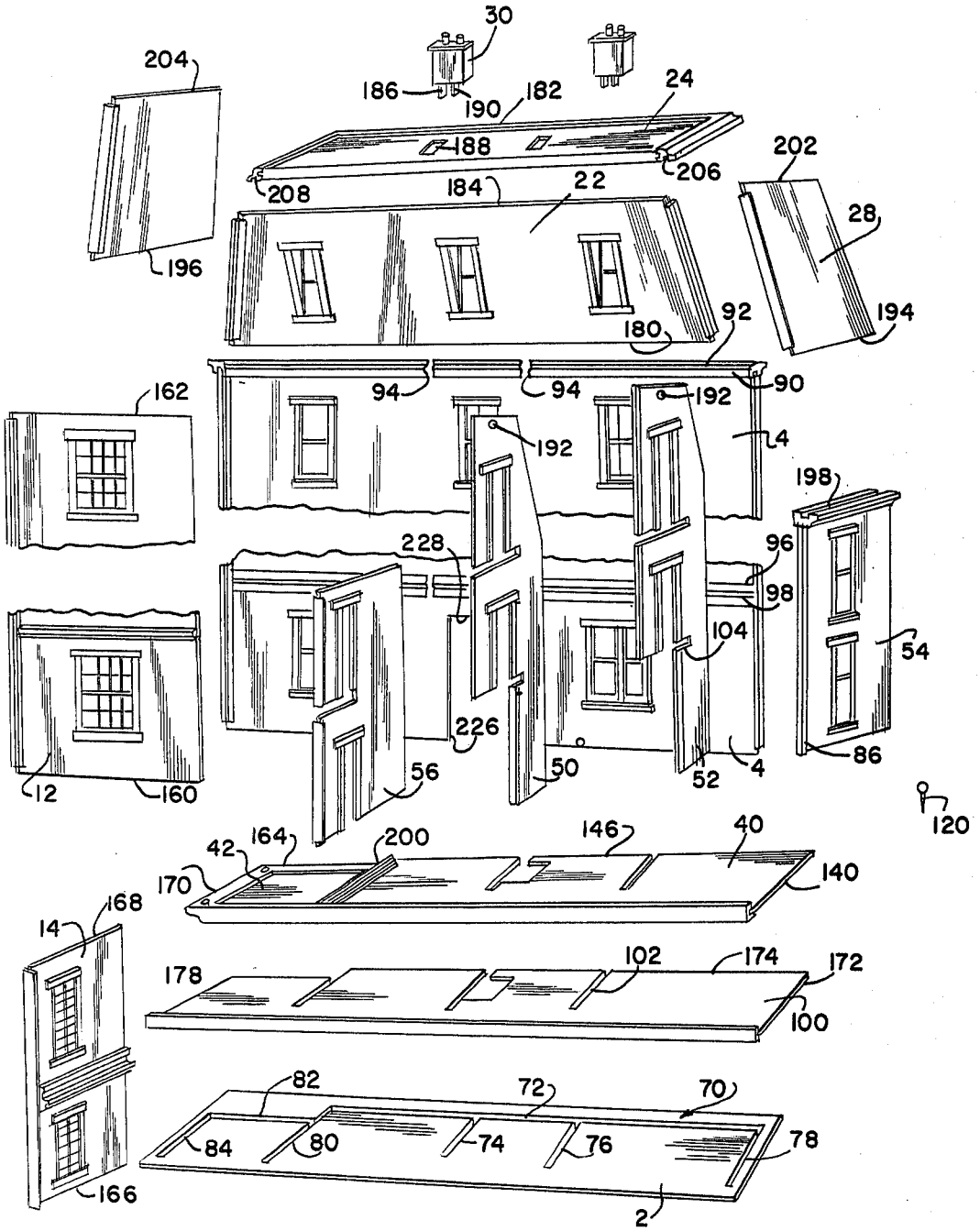
FIG. 3 is an exploded view of the doll house of FIGS. 1 and 2.

As shown in FIG. 3, base member 2 has a series of connected grooves 70 which includes a long frontal groove 72 for receiving front wall 4.

Grooves 74 and 76 receive bottom edges of relatively long vertical wall members 50 and 52. Groove 78 receives the bottom edge of relatively short outer wall member 54 and groove 80 receives the lower edge of relatively short interior wall member 56. Groove 82 receives the lower edge of the second frontal wall member 12 and groove 84 receives the lower edge of side wall member 14.

As shown in the drawings the exposed edges of the vertical wall members 14, 50, 52, 54, and 56 are provided with vertically grooved strips 86 which provide a finished appearance and which abut the base at the end of grooves 84, 74, 76, 78, and 80 respectively to provide a finished appearance as well as providing additional support structure.

In FIG. 3 the elements are shown in a exploded view out of their normal position and some of the elements are shrunk while other of the elements are stretched or divided to emphasize the details. The arrangement and the relative size of the elements are best observed with relation to FIG. 2 and other assembled views.

As shown in FIG. 3, slotted moldings are provided an intersections of panel elements to provide secure interconnections. Molding element 90 at the top of front wall 4 has a rearward opening slot 92 to receive the forward edge of floor member 40. Vertical slots 94 in the molding receive forward edges of the relatively tall interior wall elements 50 and 52. Molding 96 has a slot 98 which receives the forward edge of intermediate floor member 100. Appropriate slits such as 102 in floor member 100 and 104 in vertical wall 52 cooperate to interengage the orthogonol related elements.

The connection between the front walls 4 and 12 and the interior wall 56 is schematically shown in detail on FIG. 3A. Element 106 has slot 108 for receiving a vertical edge of the front wall 4. Slot 110 receives a vertical inner edge of wall 12, and slot 112 receives the forward vertical edge of interior wall 56.

In initial steps of assembly a door and step assembly 10 are inserted in front wall 4. The front door assembly and the porch steps have grooves on both sides. The door assembly and porch steps are slid up into the door opening. When they are properly in place, the lower edge of the front wall extends slightly below the porch steps for fitting into groove 72 in the base. The lower edge of outer side wall 54 is fitted into groove 78 in the base and the forward edge of panel 54 fits within an angle strip glued along the flat edge of front panel 4.

Figure 4:
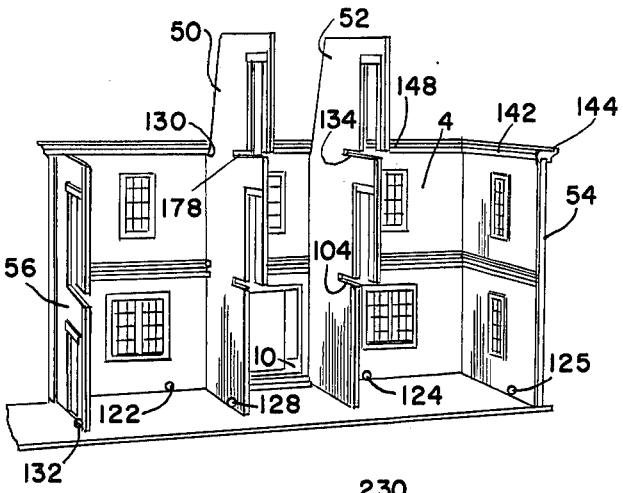
FIG. 4 is a detail of a partially-assembled from of the doll house shown in FIGS. 1–3.

Three pegs 114, 120 are then inserted in positions 122, 124, and 125 as shown in FIG. 4.

Bottom edges of the tall vertical wall members 50 and 52 are inserted in grooves 74 and 76 of base member 2 respectively, and pegs are inserted in positions 128 and 130. The bottom edge of vertical interior wall member 56 is inserted in slot 80 in base 2, and a peg is provided at position 132.

Figure 5:
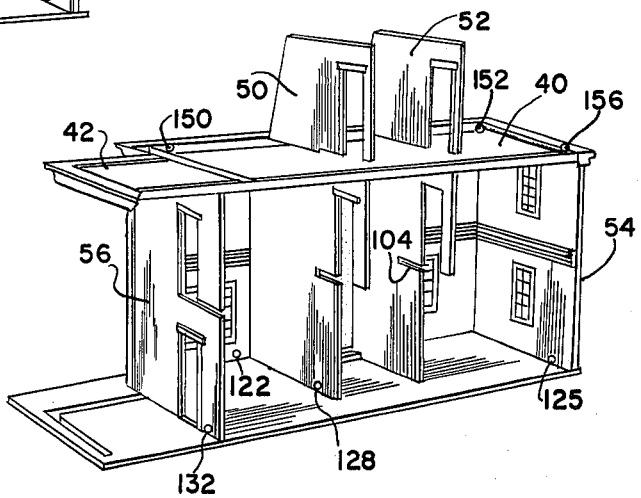
FIG. 5 is a detail of a main portion of the assembled skeletal structure of the doll house of the present invention.
Figure 6:
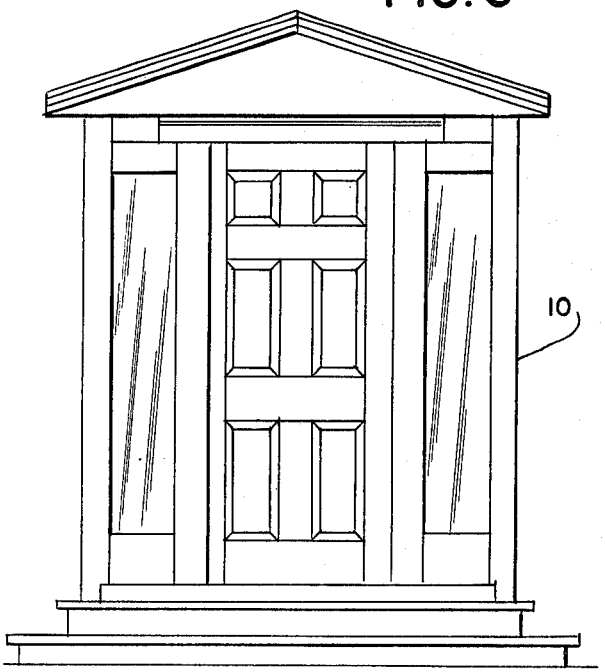
FIG. 6 is a detail of the door of the present invention.

The third floor member 40 is then inserted through slots 134 and 138 of vertical members 50 and 52. The right edge 140 is carefully slid along slot 142 of member 144 which is glued at top wall 54. The front edge 146 of floor member 40 is carefully slid into slot 148 in the crown atop the front wall 4. The top edge of wall member 56 is inserted in a downwardly disposed intermediate grooved beam member in the third floor member 40. The structure then appears as shown in FIG. 5.

Pegs are inserted at positions 150, 152, and 156.

In the next steps, the cantilevered portion 42 of floor member 40 is slightly flexed upwardly. The second front panel 12 is inserted with its bottom edge 160 in groove 82 and its upper edge 162 in a downward opening groove in element 164 on floor member 40. Continuing to flex the cantilevered portion 42 upward, outer wall 14 has its lower edge 166 inserted in groove 84 of base 2 and its upper edge 168 inserted in a downward opening groove in end molding 170 of floor member 40. No pegs are required for the connections of walls 12 and 14. After the connection of the walls 12 and 14, the peg may be removed from position 128 without weakening the structure. The second floor member is then slid into place with related slots interfitting and edges 172, 174, and 178 fitting into appropriate grooves in moldings of the front and outer walls. Front roof member 22 is then placed in position with its lower edge 180 in an upward opening groove in molding 90 atop front wall 4. Upper edges of members 50 and 52 are fitted within grooves in roof top member 24 and a downward opening groove in molding 182 receives upper edge 184 of front roof member 22. Lugs 186 on chimneys 30 are fitted through openings 188 in the top roof member 24 and pins are inserted through openings 190 and complimentary openings 192 near the upper edges of vertical wall members 50 and 52.

Roof side panels 28 are slipped into place with lower edges 194 and 196 positioned in grooves 198 and 200 respectively in the wall member 54 and floor member 40. Upper edges 202 and 204 are inserted in downward opening grooves 206 and 208 in edge moldings of the upper roof member 24.

As shown in detail in FIGS. 6, 7, 7A, and 7B, door 10 has a door portion 210 and a step portion 212.

Figure 7A:
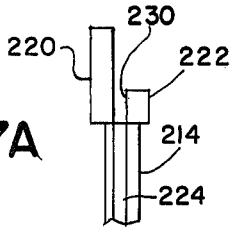
FIG. 7A is a detail of the side of the door assembly and FIG. 7B is a detail of a side of the step portion of the door assembly.
Figure 7:
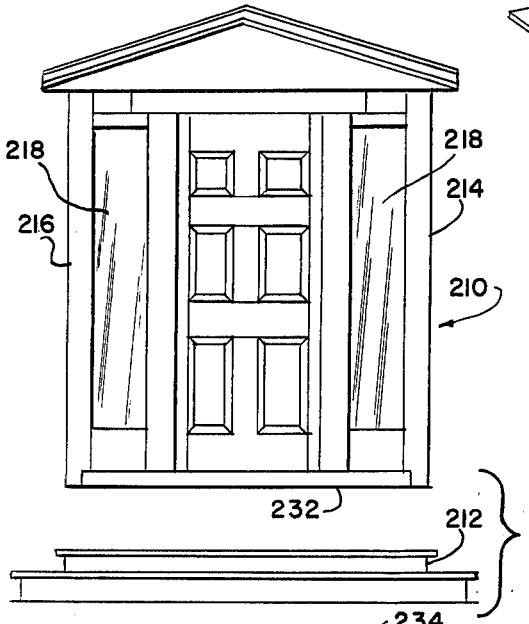
FIG. 7 is an exploded detail of the door assembly shown in FIG. 6.
Figure 7B:
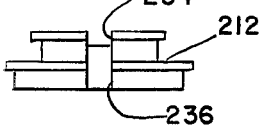

Door 210 has side members 214 and 216 which include side lights 218. Atop the side members 214 and 216 are mounted outer facial member 220 and interior facial member 222 as shown in detail in FIG. 7A. The side members have vertical grooves 224 which receive edges 226 of the door opening as shown in FIG. 3. Upper edge 228 of the door opening is received within groove 230 between the outer and inner facial elements 220 and 222. The lower edge 232 of the door assembly fits downward within upward groove 234 of the step assembly as shown in FIG. 7B. The step assembly 212 has vertical side grooves 236 which receives edges 226 of the door opening.

Because of the unique construction of the present invention, wall panel elements and rooms may be added to the doll house without adding connectors. The addition of such rooms enables reduction in connection elements.

The advantages of the invention may be obtained in multiplications such as those having a single vertical element and lateral extensions of the doll house in opposite directions.

Variations and modifications of the invention may be constructed without departing from the scope of the invention which is defined in the following claims.

What is claimed is:

1. An easily assembled knock-down doll house apparatus comprising a base having plural connected angularly oriented slots for receiving bottom edges of vertical walls, the slots comprising a first elongated slot slightly spaced inward from a first elongated edge of the base for receiving a front vertical wall member and plural slots communicating with the first elongated slot and extending angularly therefrom toward a second opposite elongated edge of the base, and a further slot extending angularly outward from an outer one of the plural slots and extending toward an edge of the base intermediate the first and second elongated edges, a remote slot extending from a portion of the further slot remote from the outer one of the plural slots toward the second elongated edge of the base, a front vertical wall member mounted in the first elongated slot, vertical transverse wall members mounted in the plural slots, the vertical transverse wall members comprising at least one relatively short outer wall member mounted in the outer one of the plural slots and at least one relatively tall inner wall member, a floor member fitted together with the vertical transverse wall members parallel to the base and spaced therefrom, the floor member extending over the relatively short outer wall member and through the relatively tall inner wall member, and the floor member cantilevering outward beyond the relatively short outer wall member and over the further slot and remote slot, a second front vertical wall member mounted in the further slot and extending between the base and a cantilevered portion of the floor member, a vertically extending connector element having a transverse portion extending between the edge of the front vertical wall member adjacent the outer one of the plural slots and the edge of the second front vertical wall member adjacent said outer one of the plural slots, a first longitudinal portion extending from an end of the transverse portion and overlying the front portion of the front vertical wall member adjacent the transverse portion, a second longitudinal portion extending from the opposite end of the transverse portion in a direction opposite the first longitudinal portion and overlying the rear portion of the second front vertical wall member adjacent the transverse portion, the portion of the transverse portion adjacent the second longitudinal portion being provided with a rearwardly opening vertical slot which receives the front vertical edge of the relatively short outer wall member, and means for connecting the base, the vertical transverse wall members and the floor member for forming thereby a rigid skeletal frame of the base, vertical transverse wall members and floor member by which a doll house comprising the members is rigidly supported.

2. The doll house in claim 1, further comprising a side vertical wall member mounted in the remote slot and extending between the base and a cantilevered portion of the floor member and having a first vertical edge fitted together with a vertical edge of the second front vertical wall member which is spaced from the relatively short outer wall member.

3. The apparatus of claim 1, wherein the relatively tall inner wall member comprises an inward and upward sloping frontal edge at positions thereof above the floor member and further comprising a roof front member having a lower edge fitted together with a front edge of the floor member, the roof front member sloping inwardly and resting against the inward sloped edge of the relatively tall inner wall member, a roof top member resting on the upper edge of the relatively tall inner wall member and having a front edge fitted together with an upper edge of the roof front member and means for connecting the roof top member to the relatively tall inner wall member thereby cooperating with the roof top member and the floor member to hold the roof front member in assembled condition, the floor member and the roof top member having complementary upward and downward opening slot means respectively, and first and second roof side members mounted in the slot means.

4. The doll house apparatus of claim 3, wherein upward opening slot means in the floor member are positioned immediately above the relatively short outer wall member and wherein a portion of the floor member cantilevered outward beyond the slot means comprises an outer deck member.

5. The apparatus of claim 1, wherein the relatively tall inner wall member is provided with a horizontal slit extending partially through the wall member and further comprising an intermediate floor member having a plan form similar to a plan form of the first said floor member and fitting within the slit and engaging in rearward opening slot means positioned on the front vertical wall member.

6. The apparatus of claim 1 wherein the front vertical wall member is provided with a door opening extending upward into the wall from a bottom edge of the wall, a door assembly for fitting in the opening, the door assembly comprising side members having outwardly facing vertical slots for receiving opposite vertical edges of the wall defining the door opening and a movable door hinged to one of the side members and abutting the other of said side members when in a closed position.

7. The apparatus of claim 6, wherein the door assembly further comprises a top member connected to the side members, the top member having an upward opening horizontal slot for receiving an upper edge of the wall defining the door opening.

8. The apparatus of claim 6, further comprising a step assembly having opposite outward opening vertical grooves for receiving vertical edges of the wall defining the door opening.

9. The easily assembled knock-down doll house apparatus of claim 1 wherein:

the base comprises a generally rectangular member having a series of in-line holes disposed behind said first elongated slot, the front vertical wall member has at least one segmented horizontal grooved molding member disposed on the inner side, one top horizontal molding member containing a top inwardly slanted groove and a rearward opening horizontal slot and an inwardly disposed vertical slot aligned with the space between the segments of the segmented horizontal grooved molding member and the plural slot in said base receiving the relatively tall inner wall member, a cutout portion adjacent said first elongated slot and at least two holes disposed at the bottom edge of the front vertical wall member, the relatively short outer wall member has its top edge engaging a downwardly disposed intermediate grooved beam member in said floor member, and further has an intermediate horizontal slot extending forwardly from the rear edge, at least one hole disposed at the bottom rear corner, and open doorways formed therein, the second front vertical wall member has its top edge engaging a groove in a downwardly disposed front beam member in said floor member, and further has an intermediate horizontal inwardly disposed grooved beam member, a side vertical wall member is mounted in the remote slot, said side vertical wall member having its frontmost side edge fitted together with said second front vertical wall member, and having its top edge engage a groove in a downwardly disposed side horizontal beam in said floor member, and further having an intermediate horizontal inwardly disposed grooved beam member, the relatively tall inner wall member has its forward edge engaging said spaces and vertical slot respectively in said segmented horizontal grooved molding member and top horizontal molding member, and further has plural vertically spaced intermediate horizontal slots extending forwardly from the rear edge; open doorways formed above and in extension of said intermediate horizontal slots, a recessed lower rear edge extending from the level of said base to the level of the lowest of said intermediate horizontal slots, a forward edge having its upper portions angled inwardly, and holes disposed at the bottom forward, and top edges, a second floor member is provided having its side edge engage said groove in said intermediate horizontal inwardly disposed grooved beam member of said side vertical wall member and its front edge engage said groove in said segmented horizontal molding member of said front vertical wall member, and further having a stairwell near the front edge, and at least two horizontal slots extending rearwardly from the front edge, said slots adapted to engage said intermediate horizontal slots of said relatively short outer wall member and said relatively tall inner wall members, a second side vertical wall member is provided having a respective size and shape to have its front edge fitted together with said front vertical wall member, and its bottom engage one of said plural slots in said base, comprising at least one inner horizontal beam member having an inwardly opening side groove, a top horizontal beam member containing a top inwardly slanted groove and an inwardly opening side groove and at least one hole disposed at the lower rear corner, the floor member is adapted to have its front edge and a side edge respectively engage said reareward opening horizontal slot in said top horizontal molding member of said front vertical wall member and the inwardly opening side groove in the top horizontal beam member of the second side vertical wall member, said floor member further comprising a stairwell near the front edge, holes disposed along the front and side edges, a side horizontal beam disposed in a downward direction, a downwardly disposed intermediate grooved beam member parallel to and longer than said side horizontal beam, an upwardly disposed top horizontal beam member directly above said downwardly disposed intermediate grooved beam member with an inwardly slanting groove disposed therein, a downwardly disposed front beam member perpendicular to and running between said side horizontal beam and downwardly disposed intermediate grooved beam member at the foremost edge of said floor member, and at least one horizontal slot extending rearwardly from the front edge, said slot adapted to engage an intermediate horizontal slot of said relatively tall inner wall member, front, left and right roof wall members disposed with bottom edges in said slanted grooves, said front roof wall member having at least two dormer window units disposed therein, a top roof member having a chimney hole disposed therein, left, right and front beam memers with outwardly slanted grooves disposed thereunder, a rear edge molding beam and said front beam member having inwardly disposed notches aligned with said relatively tall inner wall member and said chimney hole, said outwardly slanting grooves in said front, left and right beam respectively engaging the top edges of said front, left and right roof wall members, a chimney member containing a pair of parallel downwardly projecting members is received within said chimney hole with the downwardly projecting members stradling said relatively tall inner wall member and is secured thereto by a peg inserted in aligned holes in said relatively tall inner wall member and said parallel downwardly projecting members, a plurality of pegs adapted to be inserted in said holes at their junctures with each other for retaining said assembled structure together.

* * * * *